US005477645A

United States Patent [19]

Bauer

[11] Patent Number: 5,477,645

[45] Date of Patent: Dec. 26, 1995

[54] METHOD OF, AND PANEL FOR, APPLYING A GRAPHIC IMAGE TO SLAT WALLS

[75] Inventor: Jeffrey R. Bauer, Cuyahoga Falls, Ohio

[73] Assignee: Darko Company, Inc., Twinsburg, Ohio

[21] Appl. No.: 275,412

[22] Filed: Jul. 15, 1994

Related U.S. Application Data

[63] Continuation-in-part of Ser. No. 70,544, Jun. 2, 1993.

[51] Int. Cl.[6] ..... E04B 1/38

[52] U.S. Cl. ..... 52/146

[58] Field of Search ..... 52/746; 160/236; 40/605

[56] References Cited

U.S. PATENT DOCUMENTS 3,943,646 3/1976 Branham ..... 40/605

5,052,137 10/1991 Edwards ..... 40/611

5,121,578 6/1992 Holz ..... 52/506

*Primary Examiner*—Creighton Smith

*Attorney, Agent, or Firm*—Renner, Kenner, Greive, Bobak, Taylor & Weber

[57] ABSTRACT

A panel (10) for covering a slat board (12) of a slat wall (11) includes a face portion (22) having a hook member (23) at its lower end and another hook member (24) at its upper end. The hook members (23, 24) are adapted to engage the lateral edges of the slat board (12) so that the face portion (22) is adjacent to the slat board (12). Graphics (40) may be applied to the slat wall (11) by cutting the graphics (40) into strips (40A-40J) with a portion (41) therebetween being removed and discarded. Each strip (40A–40J) is then inserted into a panel (10) between hook members (23, 24), and each panel (10) is sequentially installed on a slat board (12) to recreate the graphic image (40). In another embodiment, opposed upper and lower tabs (29, 30) can be provided at the ends of face portion (22) so that graphic or other decorative material may be held therebetween.

6 Claims, 6 Drawing Sheets

METHOD OF, AND PANEL FOR, APPLYING A GRAPHIC IMAGE TO SLAT WALLS

CROSS-REFERENCE TO RELATED APPLICATION

This application is a continuation-in-part of U.S. patent application Ser. No. 08/070,544 filed Jun. 2, 1993.

TECHNICAL FIELD

This invention relates to a panel-like strip of material utilized to resurface and/or apply a graphic image to conventional slat wall structures. More particularly, this invention relates to such a material which can be utilized not only to cover damaged slat wall surfaces but which also can be utilized in a method of applying a graphic image or other promotional information on the existing slat wall structure.

BACKGROUND ART

Many retail store establishments utilize conventional slat walls to carry products being displayed for sale. These slat walls consist of horizontally oriented spaced boards or slats formed by providing horizontal slots in a pressboard, plywood or like material. A vertical slot is usually milled at the inner end of the space between the slats to form, with the space, a generally T-shaped opening between the slats. Conventional display hooks or shelves can then be mounted between the slats so that the wall can carry a multitude of products for retail display.

In addition to the initial expense of these slat walls, one problem with them relates to their maintenance. They are not only in need of frequent painting, but also, and more importantly, they are susceptible to chipping or cracking due to the frequent placement and removal or the display hooks and shelving. Such presents an unsightly problem which mere painting cannot resolve and eventually results in the need to replace the entire slat wall.

Moreover, it is extremely difficult, if not impossible, to provide promotional information or a decorative graphic image on conventional slat walls. Thus, while the retail establishment may want to promote a sale on the slat wall background of a product being displayed, or may want to adorn the establishment with some type of seasonal or other graphic image, such cannot be done with conventional slat walls unless, of course, the establishment would have a separate pre-painted wall for each promotion or desired graphic image. However, such would be highly impractical inasmuch as the establishment would have to incur the initial expense of purchasing multiple slat walls and then the recurring expense of removing the existing slat wall and installing a new slat wall each time a change would be desired.

DISCLOSURE OF THE INVENTION

It is thus a primary object of the present invention to provide an inexpensive panel for resurfacing and/or applying graphic images to the slats of a slat wall.

It is another object of the present invention to provide a panel, as above, which is made of a sturdy, damage-proof plastic material which can be easily cleaned.

It is a further object of the present invention to provide a panel, as above, which can be easily attached to and removed from an existing slat wall by a unique method of installation.

It is yet another object of the present invention to provide a panel, as above, which can be provided at desired lengths.

It is an additional object of the present invention to provide a panel, as above, which can carry graphics, if desired, so that promotional or other material may be depicted on the slat wall.

It is a still further object of the present invention to provide a panel, as above, which can be made of clear plastic and be positioned on a slat such that a graphic image can be positioned between the panel and the slat and be viewed through the panel.

It is another primary object of the present invention to provide a method of applying graphics to a slat wall utilizing the panels of the present invention.

These and other objects of the present invention, as well as the advantages thereof over existing prior art forms, which will become apparent from the description to follow, are accomplished by the means and methods hereinafter described and claimed.

In general, a panel for covering a longitudinally extending slat board of a slat wall includes a longitudinally extending generally planar face having a lateral extent generally conforming to the lateral extent of the slat board. A first hook member is positioned generally at one lateral edge of the face to engage one lateral edge of the slat board. A second hook member is positioned generally at the other lateral edge of the face to engage the other lateral edge of the slat board.

The planar face may be made transparent so that graphics may be positioned between the face and the slat board to be viewed through the face. Alternatively, or additionally, opposed tabs may be positioned generally at each lateral edge of the face to hold a sheet of material adjacent to the face.

In accordance with the method of the present invention of applying a graphic image to a slat wall, a graphic image is first cut into sequential longitudinally extending strips having a lateral dimension approximating the lateral dimension of a slat in the wall. At the same time, a portion of the graphic image between the strips is removed and discarded. The strips are then inserted into the clear plastic panels of the present invention, and the panels are sequentially snapped onto the slats to recreate the graphic image on the wall.

The panels are snapped onto each slat by engaging the slat at one longitudinal end thereof with one of the hook members and then snapping the opposed hook member over the slat at that longitudinal end. Then by pressing the panel longitudinally along and against the slat, the remainder of the panel will snap in place.

Preferred exemplary panels for resurfacing and/or applying graphics to a slat wall, and the method of installation thereof, which incorporate the concepts of the present invention, are shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
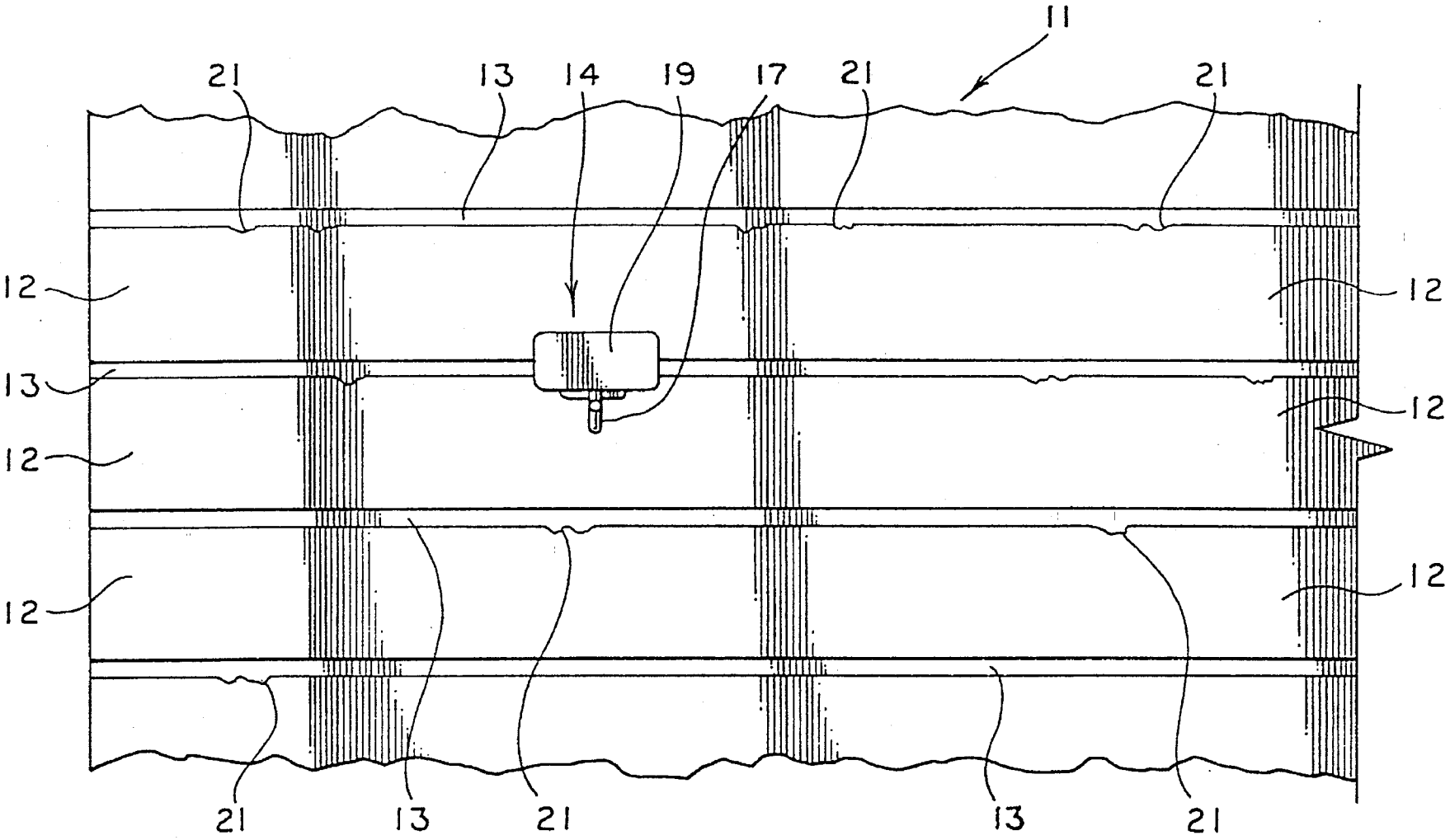
FIG. 1 is a fragmented elevational view of a portion of a conventional slat wall which forms the environment for the panel of the present invention.

A panel made in accordance with the present invention is indicated generally by the numeral 10 and is adapted for resurfacing and/or applying graphics to a slat wall indicated generally by the numeral 11. Slat wall 11 is used primarily by retail establishments to display their wares and includes a plurality of spaced boards or slats 12 which are preferably formed by cutting a plurality of T-shaped slots 13 (FIG. 2) in a conventional pressboard or plywood sheet cut to the desired size for the display wall.

Figure 2:
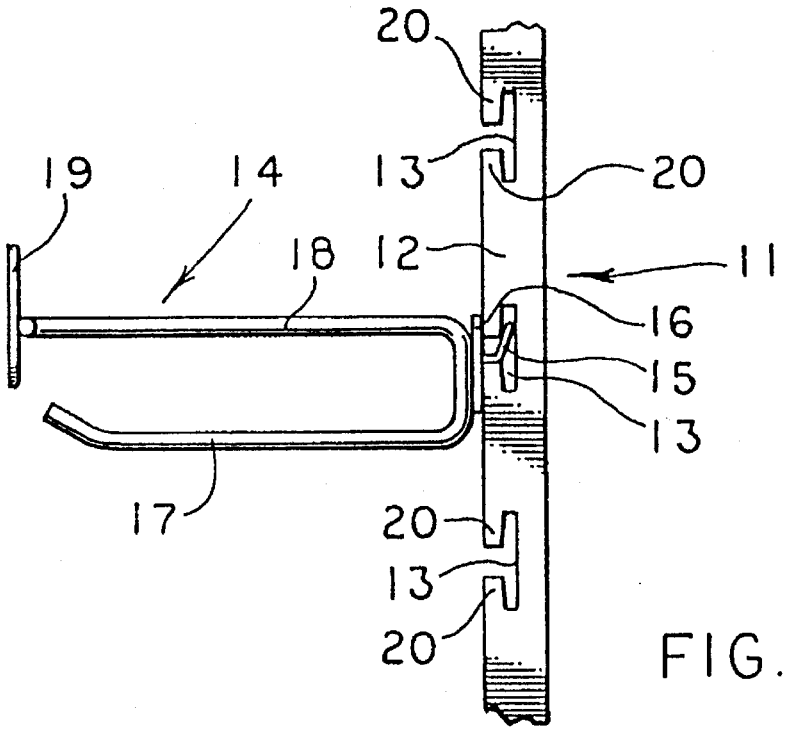
FIG. 2 is a fragmented side elevational view of the slat wall shown in FIG. 1.
Figure 3:
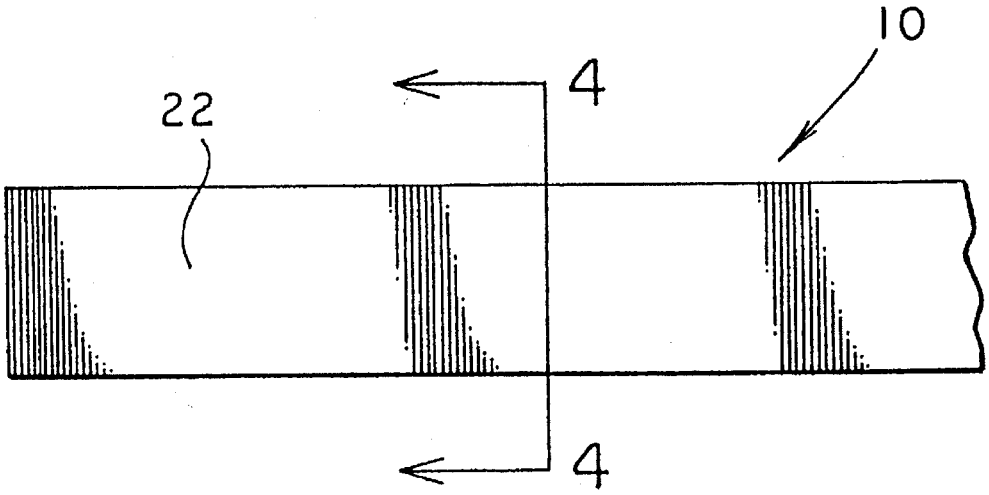
FIG. 3 is a fragmented front elevational view of a panel for resurfacing the slat wall made in accordance with the concepts of the present invention.

Slats 12 can carry a variety of product-supporting items such as shelves (not shown) or brackets, one such bracket being depicted in FIGS. 1 and 2, as representative, and being generally indicated by the numeral 14. The bracket 14 shown includes a hook member 15 which is engagable with a slot 13 to hold bracket 14 in a generally horizontal orientation as shown. The particular bracket 14 shown also has a bearing plate 16 resting against slat wall 11 and carrying a generally U-shaped member which includes a lower hooked arm 17 and an upper straight arm 18. Straight arm 18 is shown as having a generally vertically oriented face plate 19 affixed thereto. Products to be displayed on bracket 14 can be hung on hooked arm 17 and the price of the product, for example, can be displayed on face plate 19. Of course, as previously indicated, the bracket 14 shown is merely typical of a wide variety of bracket shapes or shelves which might be held by slat wall 11.

However, no matter what the configuration of the device being so held, it will always be engaged by slat wall 11 by a device similar to hook member 15 being received in slots 13. As such, with brackets 14 or like devices being continually put into, taken out of, or moved around on slat wall 11, particularly as product displays are changed, the lateral ends 20 of the face of slats 12 can be marred or chipped, as at 21 (FIG. 1), which eventually renders slat wall 11 unsightly. Merely painting wall 11, which may be frequently required in any event, does not hide chips 21 and thus eventually the wall must be replaced unless panel 10, now to be described, is employed.

Panel 10 can be made of any suitable plastic material, such as extruded polyvinylchloride, and can be precut in length to the length of the slat wall 11 on which it will be installed. Panel 10 includes a longitudinally extending generally planar outer face 22, having a lateral extent or height corresponding to the lateral extent or height of slats 12. The lower end of face 22 is provided with a rearwardly directed hook member generally indicated by the numeral 23, and the upper end of face 22 is provided with a rearwardly directed hook member generally indicated by the numeral 24.

Lower hook member 23 includes a rearwardly directed generally horizontal surface 25, that is, extending orthogonally of face 22, and an upwardly directed surface 26 extending upwardly, preferably at an angle of about 120 degrees from surface 25 at the end thereof. Surface 26 is thus spaced from and opposes face 22 of panel 10.

Upper hook member 24 includes a rearwardly directed surface 27 which preferably extends somewhat upwardly from the top of face 22 at an angle of about 120 degrees from horizontal as it extends rearwardly from face 22. A surface 28 extends downwardly from the uppermost and rearwardmost end of surface 27 preferably at an angle of approximately 140 degrees from surface 27.

Figure 6:
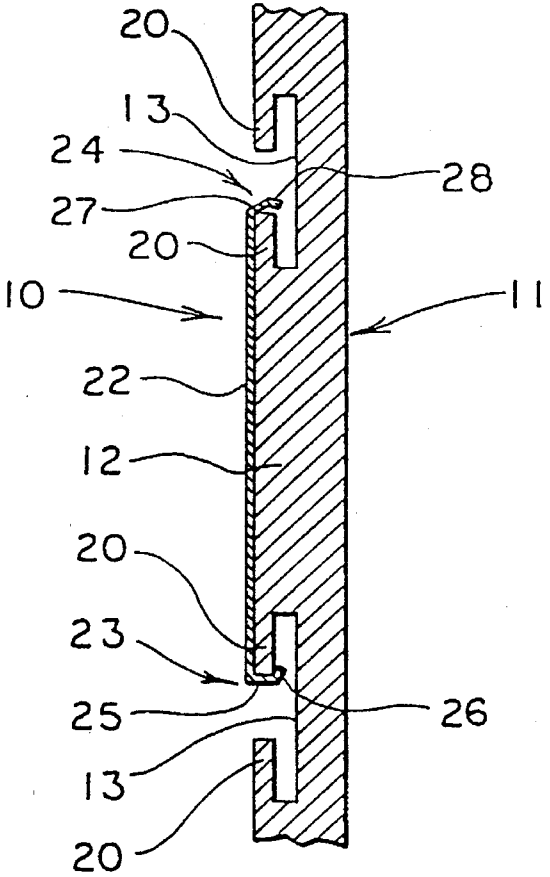
FIG. 6 is a fragmented sectional view showing a panel of the present invention installed on a slat wall.
Figure 7:
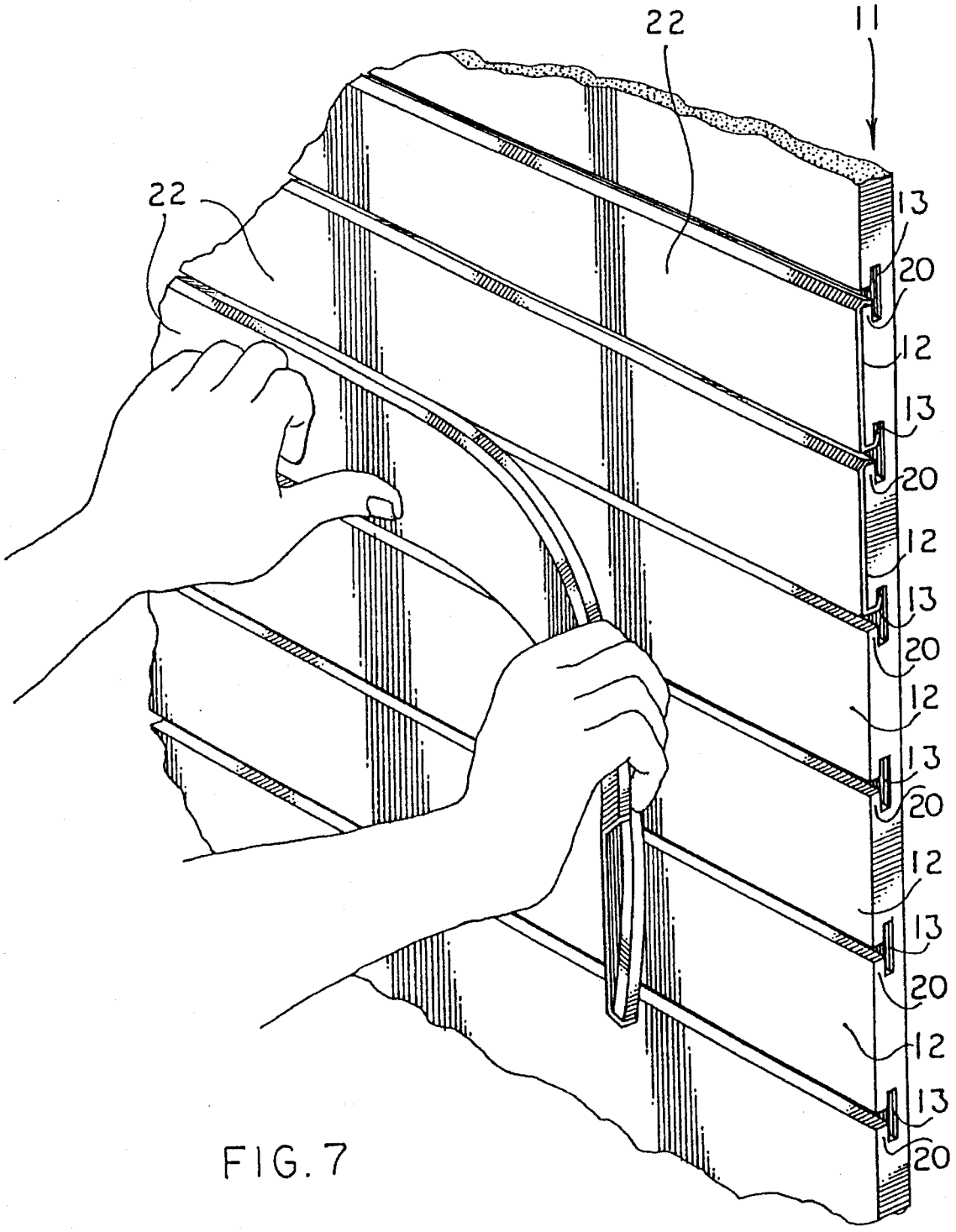
FIG. 7 is a graphic representation depicting the manner in which a panel made in accordance with the concepts of the present invention is installed on a slat wall.

Panels 10 can be readily installed on slat wall 11 in a manner depicted in FIG. 7. Preferably lower hook member 23 at one longitudinal end of panel 10 and wall 11 is first placed into the slot 13 defining the lower end 20 of a slat 12 such that hook member 23 readily engages the lower end 20 of that slat 12 with horizontal surface 25 being parallel to and adjacent to flat bottom lateral end 20 of slat 12. Then upper hook member 24 can be snapped over the top lateral end 20 of the longitudinal end of that slat 12 and into the slot 13 defining that top end 20. Such action is assisted by the fact that surface 27 is angled, as opposed to horizontal, so that it readily slides over the upper lateral end 20 of slat 12. Then one need only run his hand longitudinally along that slat 12 pressing against panel 10 as shown in FIG. 7, and panel 10 will snap into place along the entire length of that slat 12. As installed, the manner in which hook members 23 and 24 engage the ends 20 of slat 12 is best shown in FIG. 6. In order to remove a panel 10 from a slat 12, one need only overcome the holding force of hook members 23 and 24 at one longitudinal end and effectively peel panel 10 from slat 12.

Panel 10 may thus become a new surface for slats 12 hiding any chips, dents or scratches on the surface thereof. Moreover, if desired, face 22 can be painted or can be provided with verbiage to advertise the product currently being displayed on wall 11. Of course, that product can be displayed in the same manner as if panel 10 were not there; that is, shelving or brackets, such as bracket 14, can be hooked into slots 13 in the normal fashion.

In addition, panel 10 can be made of clear plastic to afford the user the opportunity to adorn his slat wall 11 with a graphic image. Such an image, for example, could be a photograph of a celebrity endorsing the products being displayed or could be a seasonal or other image which the user may wish to periodically change.

Figure 8:
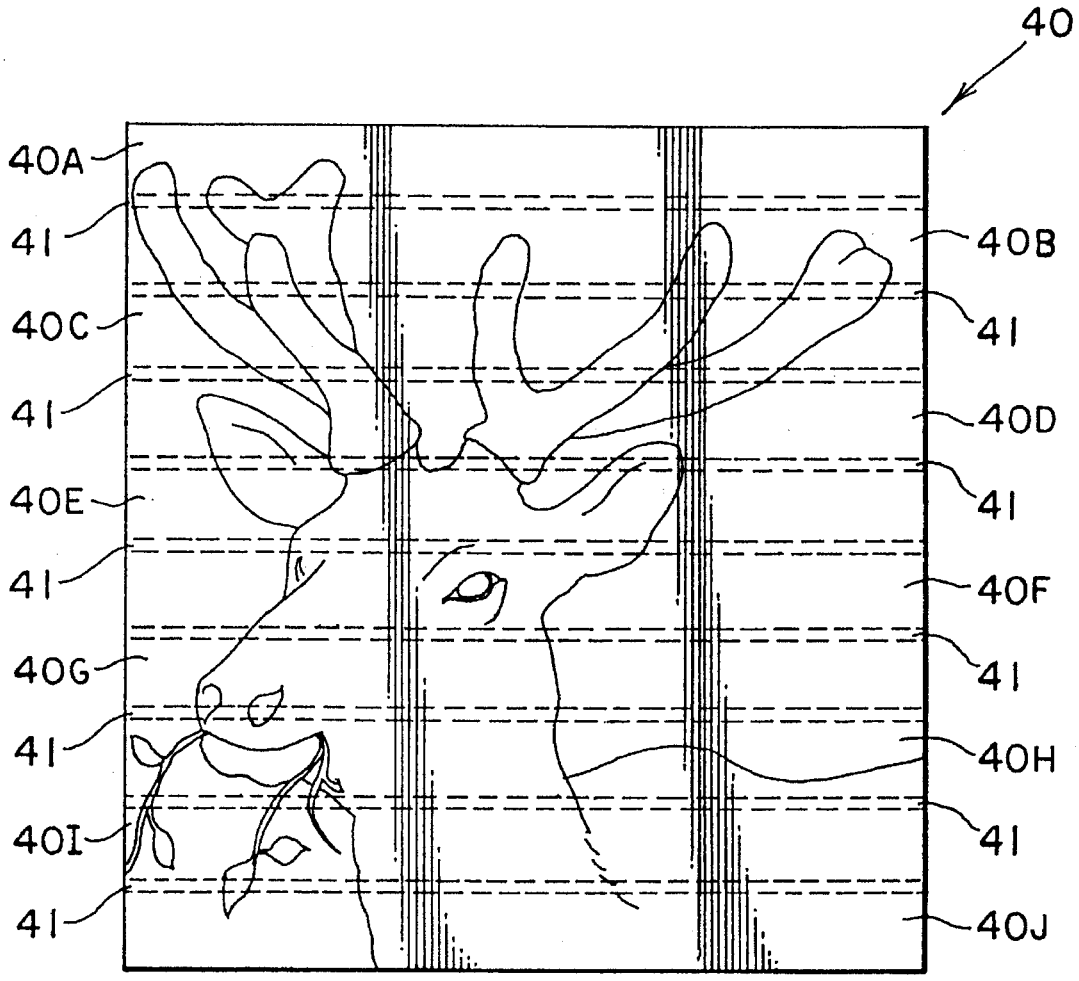
FIG. 8 is a depiction of a graphic image being prepared for being applied to a slat wall in accordance with the method of the present invention.

With reference to FIGS. 8–11, the present invention provides a method by which graphics may be applied to slat wall 11. FIG. 8 depicts a graphic image or photograph 40 showing, for example, the seasonal depiction of a reindeer. In order to prepare image 40 for the application to slat wall 11, image 40 is first cut along the dotted lines of FIG. 8 into a plurality of sequential longitudinally extending strips, 40A–40J. Strips 40A–40J are cut to be of a height or lateral dimension generally corresponding to the lateral extent of a slat 12. So as to maintain the continuity of image 40 when eventually applied to slat wall 11, small longitudinally extending portions 41 of image 40 between strips 40A–40J are cut out and discarded. The height or lateral extent of each portion 41 is made to correspond to the open dimension of slots 13 of wall 11, that is, the dimension between opposed lateral ends 20 of the face of slats 12.

Figure 9:
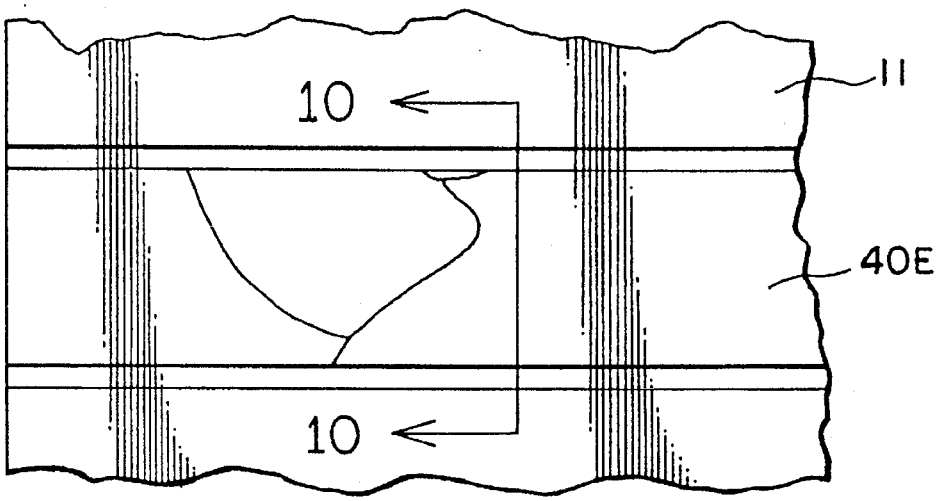
FIG. 9 is an enlarged fragmented front elevational view of a panel with a portion of the graphic image of FIG. 8 installed on a slat wall.
Figure 10:
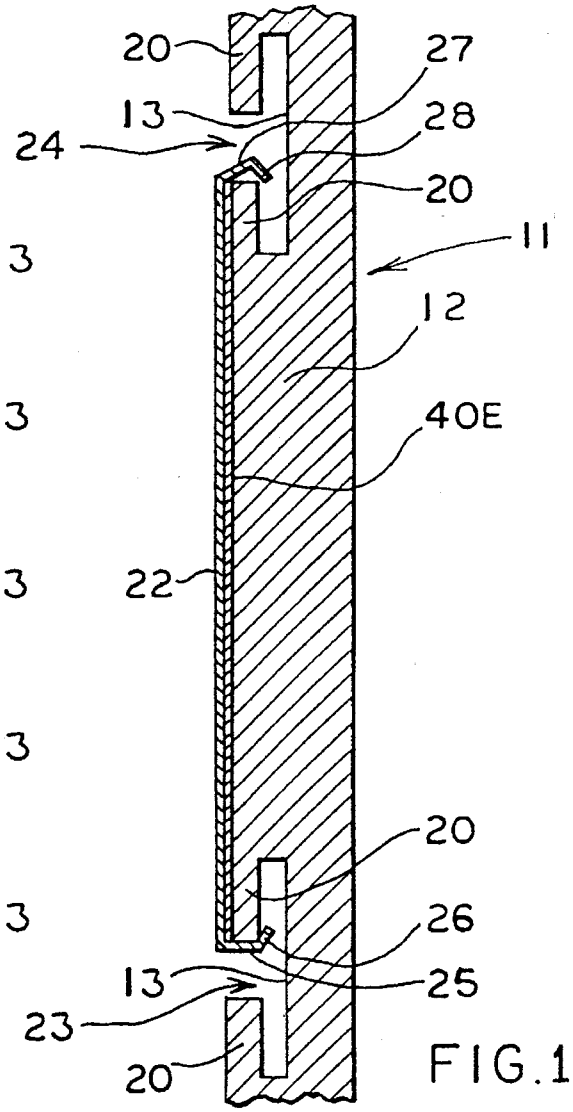
FIG. 10 is a sectional view taken substantially along line 10—10 of FIG. 9.

Each strip 40A–40J is then placed on the rear side of clear plastic face 22 between lower hook member 23 and upper hook member 24 so that the depiction can be seen through face 22 as shown in FIG. 9 with respect to strip 40E. Each panel 10 with a strip 40A–40J positioned therein, may then be sequentially installed on slats 12 in the manner previously described with respect to FIG. 7. As such, as shown in FIG. 10, each strip 40A–40J is sandwiched between a slat 12 and transparent face 22.

Figure 11:
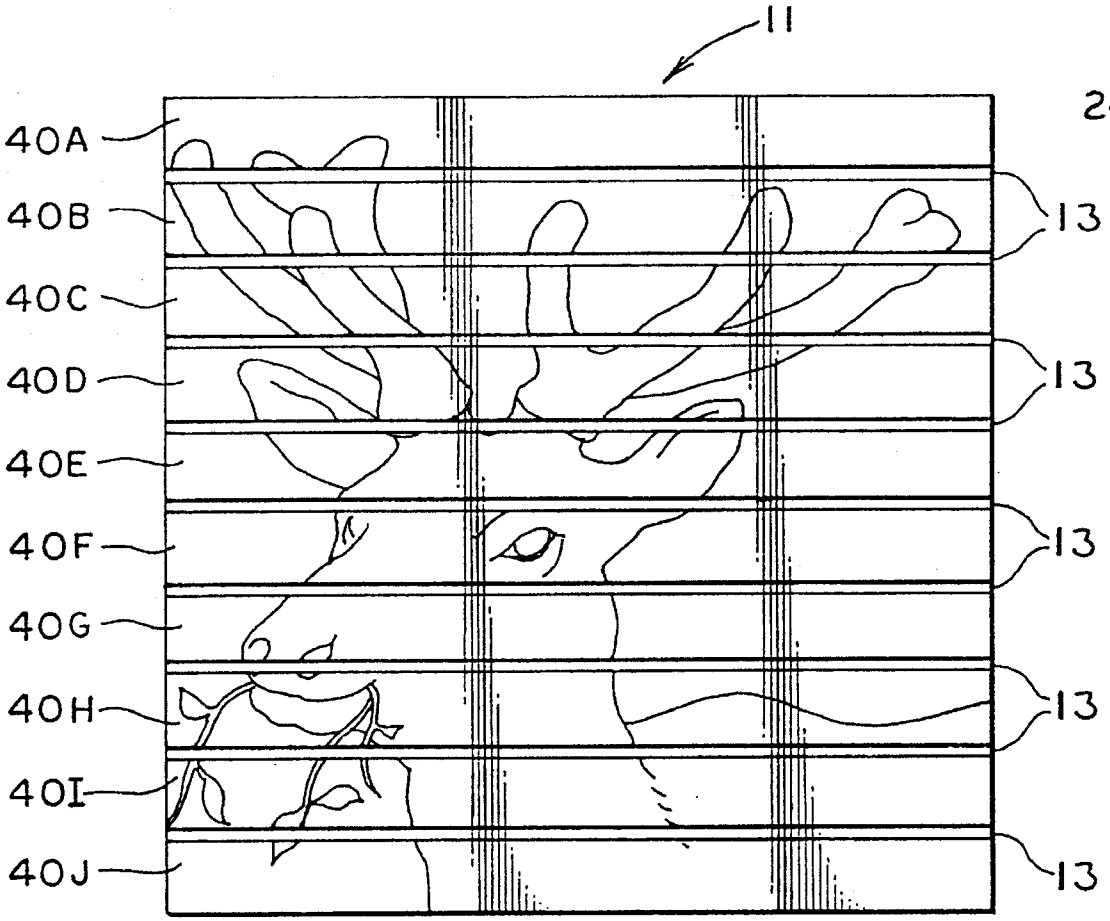
FIG. 11 is an elevational view of a slat wall having the graphic image of FIG. 8 applied thereto.

The resulting slat wall 11 with the image 40 applied thereto is shown in FIG. 11. The reindeer depiction is thus recreated thereon with the spaces between slats 12, defined by slots 13, replacing the discarded portions 41 of image 40. When it is desired to change the graphics being applied to wall 11, panels 10 are merely removed and another segmented image applied to wall 11 in a similar fashion.

Figure 5:
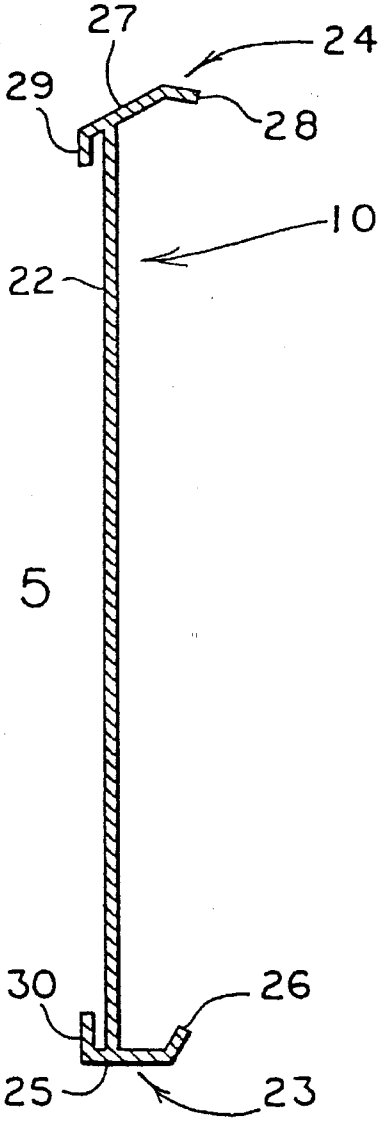
FIG. 5 is a sectional view similar to FIG. 4 and showing an alternative embodiment of a panel made in accordance with the present invention.
Figure 4:
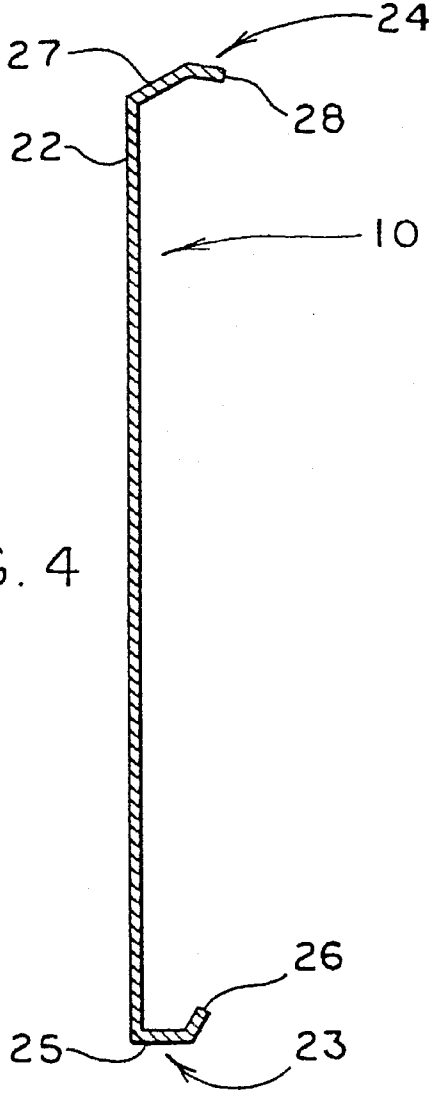
FIG. 4 is a sectional view taken substantially along line 4—4 of FIG. 3.

If the user would prefer to employ an even more readily removable graphic strip, the alternative embodiment of panel 10, as depicted in FIG. 5, may be utilized. This embodiment is identical to that shown in FIG. 4 except that an upper tab 29 extends longitudinally along, and downwardly and spaced from the top of the front of face 22, and an opposed lower tab 30 extends longitudinally along, and upwardly and spaced from the bottom of the front of face 22. A graphic strip of promotional, decorative, or other material, such as strips 40A–40J or strips of any laminate material of a desired appearance, can then be longitudinally threaded between tabs 29 and 30 so that it is confined thereby against face 22 which, of course, in this instance need not be transparent.

It should be appreciated that a panel constructed as described herein enables one to readily apply graphics to existing slat walls and otherwise accomplishes the objects of the present invention to substantially improve the slat wall art.

I claim:

1. A method of applying a graphic image to a wall consisting of a plurality of longitudinally extending vertically spaced slats comprising the steps of cutting the graphic image into sequential longitudinally extending strips having a lateral dimension approximating the lateral dimension of the slats while at the same time removing and discarding a portion of the graphic image between the strips, inserting the strips into clear plastic panels, and snapping the clear plastic panels sequentially onto the slats to recreate the graphic image on the wall.

2. A method according to claim 1 wherein each panel has a longitudinally extending planar face and hook members extending from each lateral edge of the face, the step of inserting including the step of positioning each strip against each face and between the hook members.

3. A method according to claim 2 wherein each strip of the graphic image is positioned between each face and each slat so that it is exposed through the clear plastic face.

4. A method according to claim 2 wherein the step of snapping includes the steps of engaging one longitudinal end of a slat with the hook members on one lateral edge of the face, snapping the hook members on the other lateral edge of the face over the one longitudinal end of the slat, and pressing the planar face longitudinally along and against the slat to snap the remainder of the panel in place on the slat.

5. A method according to claim 2 wherein each panel has tab members extending from each lateral edge of the face in the opposite direction as the hook members and further comprising the step of positioning a strip of decorative material between the tab members and adjacent the face.

6. A method according to claim 1 wherein the lateral extent of the removed and discarded portion is approximately the same as the space between the vertically spaced slats.

* * * * *